US010126017B2

(12) United States Patent
Noman et al.

(10) Patent No.: US 10,126,017 B2
(45) Date of Patent: Nov. 13, 2018

(54) STRAIN REDUCTION CLAMSHELL HEAT EXCHANGER DESIGN

(71) Applicant: Lennox Industries Inc., Richardson, TX (US)

(72) Inventors: Shiblee S. M. Noman, Carrollton, TX (US); John W. Whitesitt, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 743 days.

(21) Appl. No.: 13/715,268

(22) Filed: Dec. 14, 2012

(65) Prior Publication Data

US 2014/0165990 A1 Jun. 19, 2014

(51) Int. Cl.

| | |
|---|---|
| ***F24H 3/10*** | (2006.01) |
| ***F24H 9/00*** | (2006.01) |
| ***F28D 9/00*** | (2006.01) |
| ***F24D 5/00*** | (2006.01) |
| ***F28F 3/12*** | (2006.01) |

(52) U.S. Cl.

CPC ..... *F24H 3/105* (2013.01); *F24D 5/00* (2013.01); *F24H 9/0063* (2013.01); *F24H 9/0068* (2013.01); *F28D 9/0031* (2013.01); *F28F 3/12* (2013.01)

(58) Field of Classification Search

CPC ..... F24H 3/105; F28D 9/0031

See application file for complete search history.

(56) References Cited

U.S. PATENT DOCUMENTS

| | | | | | |
|---|---|---|---|---|---|
| 2,762,612 | A * | 9/1956 | Druseikis | F24H 3/105 | 126/116 R |
| 2,796,860 | A * | 6/1957 | Pinkus | F24H 3/105 | 126/116 R |
| 2,963,083 | A * | 12/1960 | Spieth | F24H 3/105 | 126/110 B |
| 3,073,296 | A * | 1/1963 | Hollingsworth | F24H 3/105 | 126/110 R |
| 3,140,706 | A * | 7/1964 | Block | F24H 3/105 | 126/110 R |
| 3,871,354 | A * | 3/1975 | Jackson | B60H 1/2212 | 126/110 B |
| 4,982,785 | A * | 1/1991 | Tomlinson | F24H 3/105 | 126/110 R |
| 5,060,722 | A * | 10/1991 | Zdenek | F24H 3/105 | 126/110 R |
| 5,309,892 | A * | 5/1994 | Lawlor | F24H 3/065 | 126/110 AA |
| 5,347,981 | A * | 9/1994 | Southern | F23N 5/245 | 126/110 R |
| 5,542,470 | A * | 8/1996 | Evens | F24H 3/105 | 126/119 |
| 5,704,343 | A * | 1/1998 | Ahn | F24H 8/006 | 126/110 R |

(Continued)

*Primary Examiner* — Kenneth Rinehart
*Assistant Examiner* — Logan Jones
(74) *Attorney, Agent, or Firm* — Winstead PC

(57) ABSTRACT

One aspect of this disclosure provides a heating chamber for a gas furnace that comprises opposing halves joined together. The joined opposing halves form a clamshell panel having at least one truncated corner located adjacent a curve located at a back end of a chamber path of the one or more clamshell heating chambers.

8 Claims, 4 Drawing Sheets

(56) References Cited

U.S. PATENT DOCUMENTS

| | | | | |
|---|---|---|---|---|
| 5,799,646 | A * | 9/1998 | Zia | F23C 3/002 126/110 AA |
| 6,257,870 | B1 * | 7/2001 | Hugghins | F23N 3/082 126/116 A |
| 6,938,688 | B2 * | 9/2005 | Lengauer, Jr. | F24H 3/105 165/146 |
| 8,261,733 | B2 * | 9/2012 | Hugghins | F23N 1/022 126/112 |
| 2011/0174291 | A1 * | 7/2011 | Manohar | F23C 3/002 126/112 |
| 2012/0297337 | A1 * | 11/2012 | St. Denis | G08G 1/168 715/810 |
| 2012/0325445 | A1 * | 12/2012 | Dinulescu | B21D 51/52 165/166 |

* cited by examiner

STRAIN REDUCTION CLAMSHELL HEAT EXCHANGER DESIGN

TECHNICAL FIELD

This application is directed, in general, to heating, ventilation and air conditioning (HVAC) systems and, more specifically, to a gas furnace that comprises a clamshell heat exchanger having reduced plastic strain.

BACKGROUND

A conventional gas furnace typically employs several heat exchangers, which form a heating zone to warm an air stream passing through the furnace. An 80% furnace is one where approximately 80% of the energy put into the furnace is converted into heat for the purposes of heating the targeted space. These 80% furnaces include "clamshell" or individual panel halves typically formed by stamping mirror images of the combustion chambers into corresponding metal sheets and coupling them together. The air passes through the heating zone from a blower or fan. These 80% furnaces are also characterized by high operating temperatures, which can cause failure within the heating chamber. As a result, hot spots can occur at certain points in the passageway of the clam shell heat exchanger. The high operating temperatures that create these hot spots can create cracking problems, often referred to as "hot cracks" in the clamshell heat exchanger panels. When such cracks appear, their occurrence is considered a failure of the system. To circumvent these problems, some manufacturers have turned to more expensive sheet metal materials, such as Drawing Quality High Temperature (DQHT) sheet metal materials.

SUMMARY

One aspect of this disclosure provides a gas furnace, comprising a housing, a heating zone located in the housing and comprising one or more clamshell heating chambers. The one or more clamshell heating chambers comprise opposing halves joined together and the joined opposing halves form a clamshell panel having at least one truncated corner located adjacent a curve in a backend of a chamber path of the one or more clamshell heating chambers. The gas furnace further comprises a blower having an exhaust opening and located adjacent the heating zone and positioned to force air through the heating zone.

Another embodiment provides a heating chamber for a gas furnace that comprises opposing halves joined together. The joined opposing halves form a clamshell panel having at least one truncated corner located adjacent a curve located at a back end of a chamber path of the one or more clamshell heating chambers.

A method of fabricating a gas furnace is also provided. One method embodiment comprises forming opposing halves of a heating chamber, joining the first and second opposing halves to form a clamshell panel, and forming at least one truncated corner located adjacent a curve at a backend of a chamber path of the clamshell panel.

BRIEF DESCRIPTION

Reference is now made to the following descriptions taken in conjunction with the accompanying drawings, in which.

DETAILED DESCRIPTION

Figure 1:
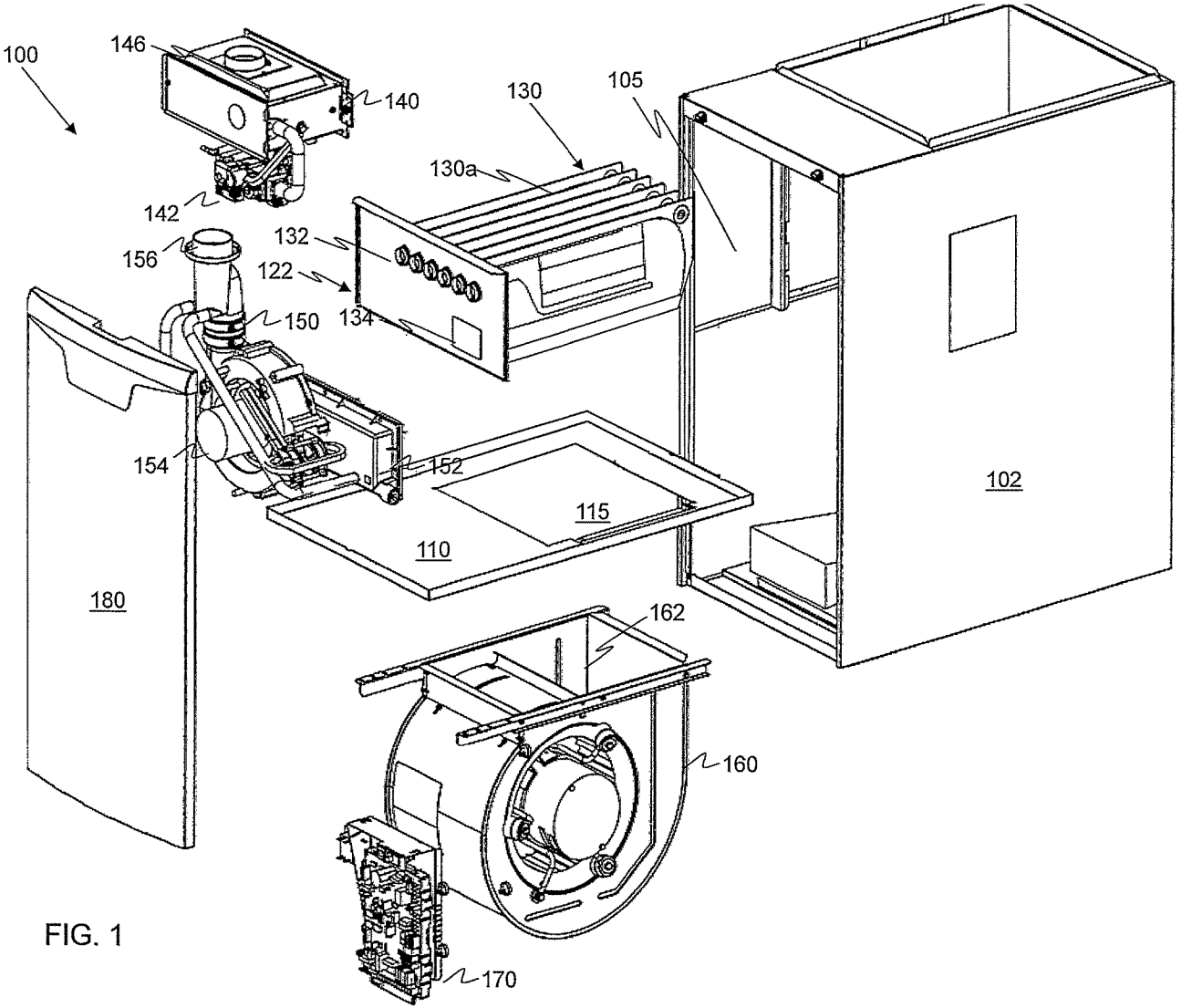
FIG. 1 illustrates an exploded isometric view of a portion of one embodiment of a furnace within which the heating chamber as provided herein may be employed.

Described herein are various embodiments of an improved clamshell heating chamber that can be employed in a gas furnace. The present disclosure is based on the discovery that failures typically not only occur in the form of cracks in hot spots (e.g., temperatures of about 1000 degrees), which are known as "hot cracks," but failure also occurs near relatively cooler spots (e.g. temperatures of about 600 degrees), which are known as "cold cracks" and are the result of high plastic strain within the clamshell panel. The plastic strain is an important variable to the thermal loading, which causes fatigue and cracking failure. The present disclosure recognizes that the plastic strain can be reduced by modifying the existing clamshells by truncating the corner adjacent a cold crack region. Cold crack regions are of particular concern because the hot crack regions can be addressed with baffling or other known solutions that work in view of the higher operating temperatures in that region. However, those techniques do not work well in the cold crack regions due to the relatively lower operating temperatures in those particular regions of the heating chamber.

In one embodiment, at least one of the corners of the clamshell panel is truncated at a specific location near a known cold crack region, which often occurs in a bend or curve in the chamber path located near the back end of the clamshell panel. The cold cracks occur as the result of the deformation, which is caused by thermal expansion, of the female panel (outer panel) imposing a pulling force on the joined male panel (inner panel). However, when the corner of the clamshell panel is truncated by either forming it at an angle of less than 90 degrees or bending the corner in a generally vertical direction along that same angle, the female panel imposes less pulling force on the male panel, and thus reduces the plastic deformation on the male panel. The angle of and distance from the corner near the cold crack region also enhances the benefits associated with the truncation configuration. It has been observed that improved results can be obtained when the truncation is located a distance of 0.0 inches to about 0.50 inches from the line of the cold crack region at the bend or curve of the heating chamber passageway. The angle of the truncation also plays a roll on the plastic stress reduction. The beneficial effects can be obtained from a truncation angle that ranges from about 30 degrees to about 75 degrees. In one specific embodiment, the truncation distance may be about 0.30 inches and at an angle of 60 degrees.

In another embodiment, the corner truncation is effected by bending the corner of the clamshell panel at the desired angle and distance. In such embodiments, about a 30 degree to about a 75 degree bend angle near the cold crack area tangent to the curved profile line was found to decrease the plastic strain by imposing pre-compressive stress to act against the thermal tensile stress. In one aspect of this embodiment, at a distance of about 0.30 inches, the angle requirement is about 60 degrees to obtain similar results to that of the previous embodiment.

The heating chambers of 80% gas furnaces have higher surface temperatures at maximum leaving air conditions, which is typically more than 1000° F. At this temperature, a low strength steel (extra deep drawing steel known as EDDS), which is the material of choice for many manufactures, will not survive the required reliability tests. To circumvent these problems, some manufactures turn to more expensive DQHT materials or tolerate a shorter operational life of the furnace. However, given the industry drive to reduce manufacturing costs, it is desirable to use the less costly EDDS material.

To use EDDS material in current 80% gas furnace designs, it is necessary to reduce the cracking attributable to the cold crack effect. Embodiments of the clamshell configuration, as presented herein, have been found to significantly reduce the cold crack effects, even when using less costly EDDS materials.

In general, the various embodiments of the clamshell design, as provided herein, reduces the plastic strain of the clamshell panel, thereby reducing the cold cracking that often occurs in conventional designs. Without being limited by any theory of operation, it is believed that the truncated corner, which may be achieved by stamp cutting the panels of the clamshell to the appropriate angle, trimming a corner of the panel, or by bending a corner to the appropriate angle, achieves a reduction in plastic strain. The strain reduction is achieved by reducing the amount of pulling force of the female portion of the panel exerted on the male portion of the panel in the region of the cold crack area, thereby reducing cracks that occur as the result of higher plastic strain, even where EDDS type materials are used. This advantage allows manufacturers to use the cheaper construction materials without sacrificing operational life, while at the same time reducing manufacturing costs.

Though the clamshell heating chamber, as presented herein, could be used in any furnace chamber, it provides particular benefits when employed in gas furnaces where 80% of the total amount of fuel used is converted directly into heat. The benefits arise from the fact that these gas furnaces reach high operational temperatures, which cause the heating chambers to prematurely stress and crack at the above-mentioned areas.

FIG. 1 is an exploded isometric view of a portion of one embodiment of a gas furnace 100 within which embodiments of the clamshell heating chamber, as presented herein, may be employed. The gas furnace 100 includes a housing 102 having a front opening 105 within which a mounting shelf 110 is located. The mounting shelf 110 has an opening 115 therein and supports a heat exchanger assembly 120 over the opening 115. The illustrated embodiment of the heat exchanger assembly 120 has a heating zone 130 that includes a row of six clamshell heating chambers (one referenced as 130*a*) coupled to an inlet panel 122. Alternative embodiments of the heat exchanger assembly 120 have more or fewer heating chambers 130*a* coupled to the inlet panel 122 in one or more rows. In the illustrated embodiment, the heating chambers 130*a* form the heating zone 130 and are generally serpentine and have one approximately 180° fold such that the heating chambers 130*a* cross over the opening 115 two, terminating in inlets 132 and outlets 134 that are generally mutually coplanar and oriented toward the opening 105 of the housing 100.

A burner assembly 140 contains a thermostatically-controlled solenoid valve 142, a manifold 144 leading from the valve 142 and across the burner assembly 150, one or more gas orifices (not shown) coupled to the manifold 144 and one or more burners (not shown) corresponding to and located proximate the gas orifices. The illustrated embodiment of the burner assembly 140 has a row of six burners. Alternative embodiments of the burner assembly 140 have more or fewer burners arranged in one or more rows. A flue 146 allows undesired gases (e.g., unburned fuel) to be vented from the burner assembly 140. In an assembled configuration, the burner assembly 140 is located proximate the heat exchanger assembly 120 such that the burners thereof at least approximately align with the inlets 132.

A draft inducer assembly 150 contains a manifold 152, a draft inducing exhaust fan 154 having an inlet coupled to the manifold 152 and a flue 156 coupled to an outlet of the exhaust fan 154. In an assembled configuration, the draft inducer assembly 150 is located proximate the heat exchanger assembly 120, such that the manifold 152 thereof at least approximately aligns with the outlets 134 and the flue 156 at least approximately aligns with the flue 146 of the burner assembly 140.

A blower 160 is suspended from the shelf 110 such that an outlet 162 thereof approximately aligns with the opening 115. An electronic controller 170 is located proximate the blower 160 and, in the illustrated embodiment, controls the blower, the valve 142 and the exhaust fan 154 to cause the furnace to provide heat. A cover 180 may be placed over the front opening 105 of the housing 100.

In the illustrated embodiment, the controller 170 turns on the exhaust fan to initiate a draft in the heat exchangers in the heating zone 130 and purge potentially harmful unburned gases or gaseous combustion products. Then the controller 170 opens the valve 142 to admit gas to the manifold 144 and the one or more gas orifices, whereupon the gas begins to mix with air to form primary combustion air. Then the controller 170 activates an igniter (not shown in FIG. 1) to attempt to ignite the combustion air. If the output of a thermocouple indicates that the primary combustion air has not ignited within a predetermined period of time, the controller 170 then closes the valve 142 and waits until attempting to start again. If the output of a thermocouple indicates that the primary combustion air has ignited within the predetermined period of time, the controller 170 then activates the blower, which forces air upward through the opening 115 and the heat exchanger assembly 120. As it passes over the surfaces of the heat exchangers, the air is warmed, whereupon it may be delivered or distributed as needed to provide heating.

Figure 2:
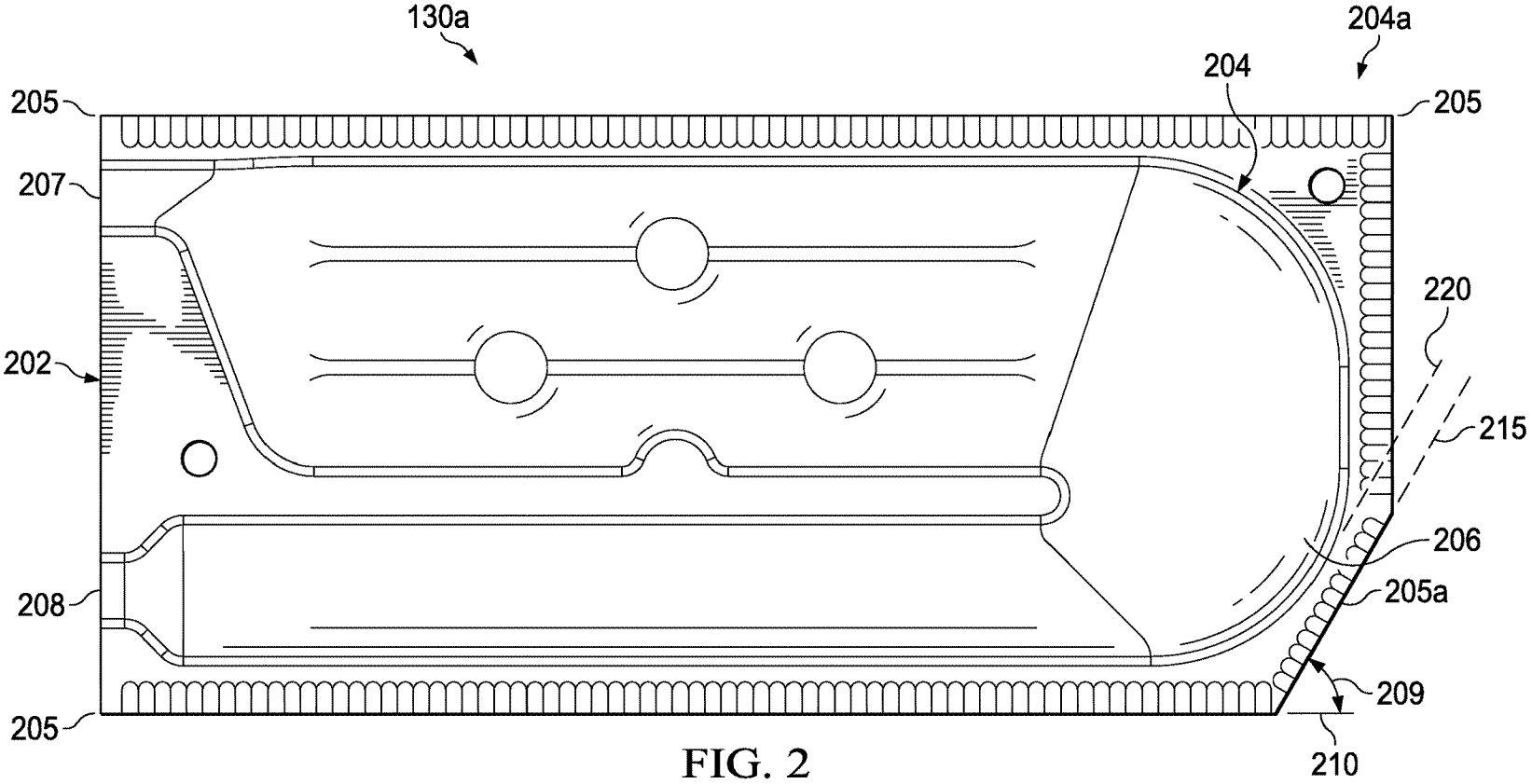
FIG. 2 illustrates one embodiment of a clamshell panel having a truncated corner.

FIG. 2 illustrates an embodiment of one of the heating chambers 130*a*, as referenced above. In this embodiment, the heating chamber 130*a* is a clamshell design wherein mirrored halves (male and female panels) are overlapped and joined together in a conventional manner to form a heating chamber panel 202 that has a chamber path 204 located near a backend 204*a* of the chamber panel 202. It should be noted, however, that the panels need not be mirror images of each other in all embodiments. Typically, the two halves are joined by one half (the female panel) overlapping the edge of the other (male panel) and being crimped together or joined in another conventional manner. Due to the method of manufacture, the heating chamber panel 202 generally has a rectangular shape with one or more right-angled corners 205. However, embodiments provide the heating chamber panel 202 wherein at least one of those corners 205 is a truncated corner 205*a* that is located adjacent a curve 206 in the chamber path 204, which is near a cold crack region located at the backend 204*a* and distal from inlet and outlet ends 207, 208 of the heating chamber panel 202. The truncation may be the result of forming the opposing panels such that an angled portion 209 (less than 90 degrees and as measure from a line of an adjacent side) is present in place of a typical right-angled corner. In alternative embodiments, the truncation may be the result of bending the corner 205, as described below.

One benefit of the present disclosure is that due to the advantages of the present disclosure, less costly sheet metal materials, such as EDDS metal, can be used in the construction of the heating chamber panel 202 in place of more expensive materials. The presence of the truncated corner 205*a* provides a reduction in the plastic strain that occurs in cold crack regions, such as those that occur in the curved area 206 of the heating chamber panel 202. The reduction in the plastic strain results in less cold cracks developing in the relatively cooler portions of the heating chamber panel 202. The degree of the angle 209 may vary depending on the embodiment. For example, the angle 209 as taken from a line of an adjacent edge 210 of the heating chamber panel 202 may range from about 30 degrees to about 75 degrees. In one aspect of this embodiment, the angle may be about 60 degrees. At this angle, finite element analysis (FEA) showed an improvement wherein the total plastic strain was reduced to about 0.002794, as compared to a total plastic strain of 0.007117 in conventional configurations using an EDDS material.

The distance of the truncation from the curve 206 in the chamber path also affects reduction in the plastic strain. For example, in one embodiment, the distance from an edge 215 of the truncated corner 205*a* to an edge 220 of the curve 206 may range from about 0.0 inches 0.50 inches. In one aspect of this embodiment, at a distance of about 0.30, the FEA showed an improvement, wherein the total plastic strain was about 0.002794, as compared to conventional total plastic strains of 0.007117 in which EDDS materials were used. In another aspect, the angle is about 60 degrees and the distance from the curve 206 is about 0.30 inches, which resulted in the above-noted improvement. Additionally, an improvement over conventional heating panels using an EDDS material was also indicated at distances of about 0.50 inches (e.g. 0.4375 inches).

Figure 3A:
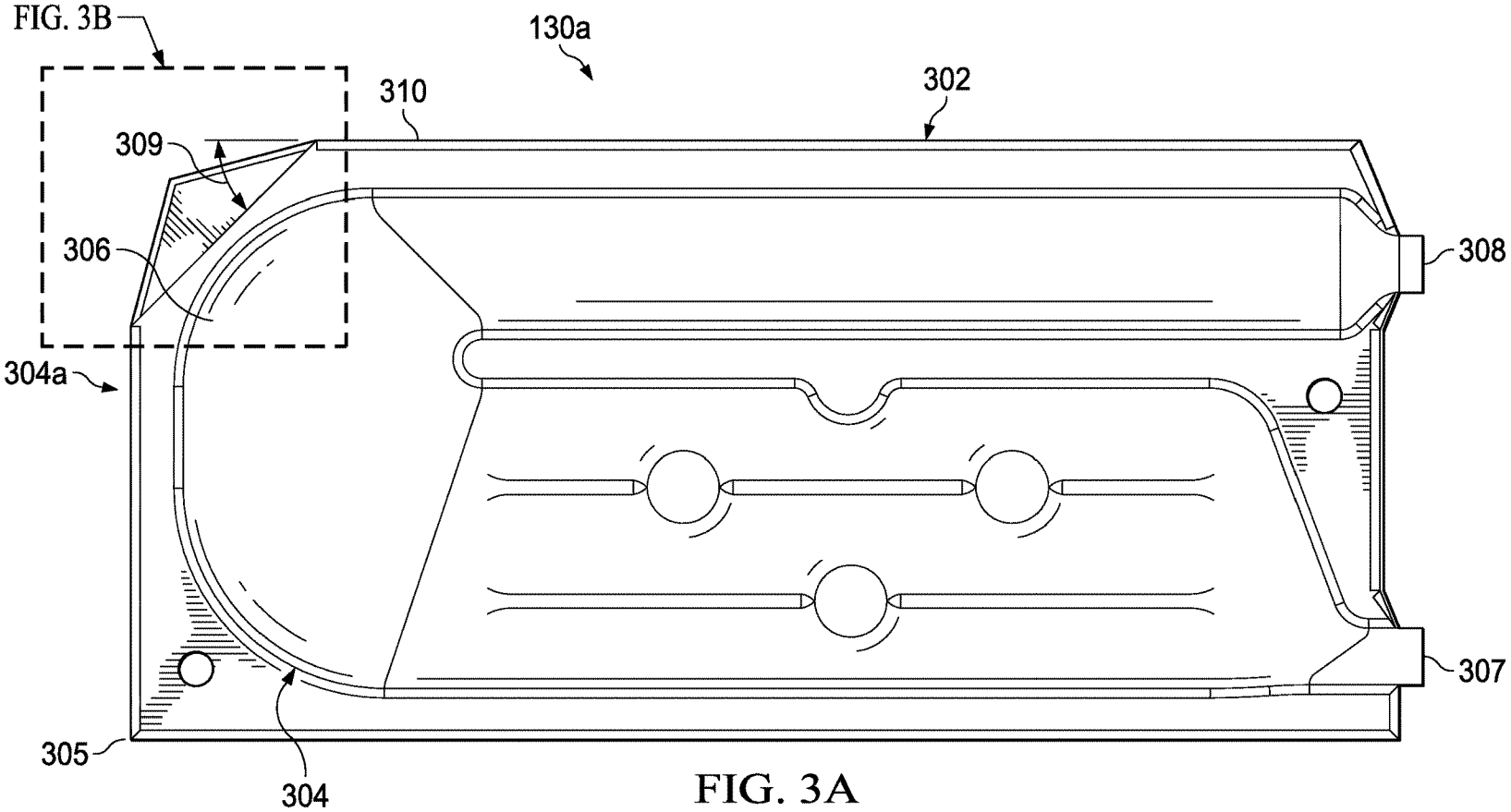
FIG. 3A illustrates another embodiment of a clamshell panel in which the truncation is in the form of a bent corner.
Figure 3B:
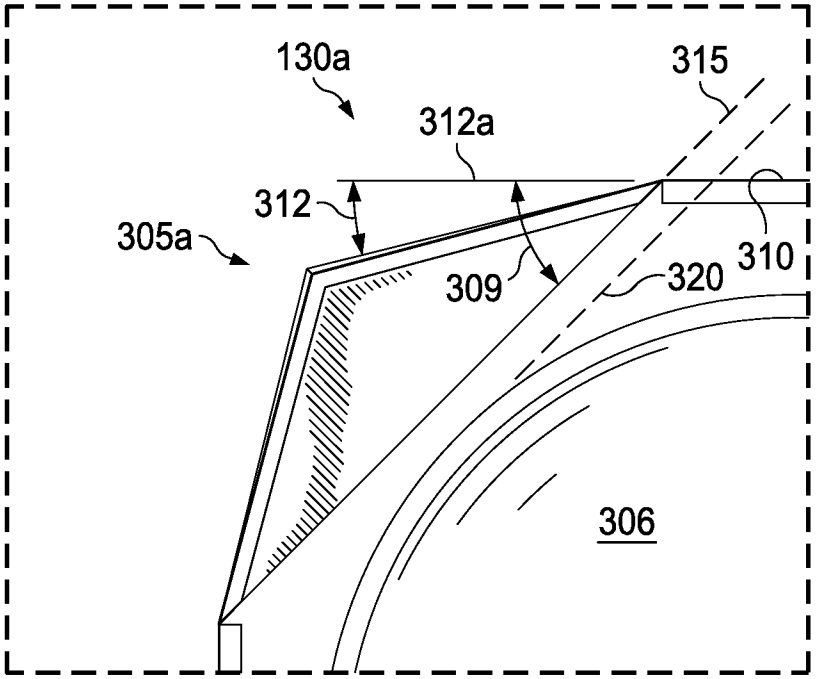
FIG. 3B is an enlarged view of the truncated corner of the clamshell of FIG. 3A.

FIGS. 3A and 3B illustrate another embodiment of the heating chambers 130*a*, as referenced above. In this embodiment, the heating chamber 130*a* is also a clamshell design wherein mirrored halves (male and female panels) are overlapped and joined together in a conventional manner to form a heating chamber panel 302 that has a chamber path 304 located near a backend 304*a* of the chamber panel 302. It should be noted, however, that the panels need not be mirror images of each other in all embodiments. Typically, the two halves are joined by one half (the female panel) overlapping the edge of the other (male panel) and being crimped together or joined in another conventional manner. Due to the method of manufacture, the heating chamber panel 302 generally has a rectangular shape with one or more right-angled corners 305. However, embodiments provide the heating chamber panel 302 wherein at least one of those corners 305 is a truncated corner 305*a* that is located adjacent a curve 306 in the chamber path 304, which is near a cold crack region located at the backend 304*a* and distal from inlet and outlet ends 307, 308 of the heating chamber panel 302. In this embodiment, the truncation is achieved by bending the corner 305*a* toward the male panel (upper surface in FIG. 3) at an angle 309 as taken from an adjacent edge 310 and by bending the corner 305*a* in generally a vertical direction at an angle 312 as taken from a bottom plane (represented by line designated 312*a*) of the female panel (not seen in this view). In various embodiments, angle 309 may range from about 30 degrees to about 75 degree, with good reduction in plastic strain being achieved at 60 degrees. Angle 312 may range from about 10 degrees to about 15 degrees.

One benefit of this embodiment is that due to the advantages of the present disclosure, less costly sheet metal materials, such as EDDS metal, can be used in the construction of the heating chamber panel 302 in place of more expensive materials. The presence of the truncated corner 305*a* provides a reduction in the plastic strain that occurs in cold crack regions, such as those that occur in the curved area 306 of the heating chamber panel 302. In those embodiments where the angle 309 was 60 degrees and angle 312 ranged from about 10 degrees to about 15, FEA showed an improvement wherein the total plastic strain was reduced to about 0.002794, as compared to a total plastic strain of 0.007117 in conventional configurations using an EDDS material.

The distance from the curve 306 in the chamber path also affects reduction in the plastic strain. For example, in one embodiment, the distance from an edge 315 of the truncated corner 305*a* to an edge 320 of the curve 306 may range from about 0.0 inches 0.50 inches. In one aspect of this embodiment, at a distance of about 0.30 and an angle 309 of 60 degrees, the FEA showed an improvement, wherein the total plastic strain was about 0.002794, as compared to conventional total plastic strains of 0.007117 in which EDDS materials were used. Additionally, an improvement over conventional heating panels using an EDDS material was also indicated at distances of about 0.50 inches (e.g. 0.4375 inches).

With reference to FIGS. 1-3B, another embodiment of this disclosure provides a methodology of fabricating of a gas furnace heating chamber 130*a*. This embodiment comprises forming opposing halves of a heating chamber 130*a*, joining the opposing halves to form a clamshell panel 202, 302 such that an outer edge of a first of the opposing halves overlaps an outer edge of a second of the opposing halves, and forming at least one truncated corner 205*a*, 305*a* located adjacent a backend curve 206, 306 of a chamber path 204, 304 of the clamshell panel 202, 302. It should be understood that conventional sheet metal processes may be used to achieve the disclosed configurations. For example, the truncated corner 205*a*, 305*a* may be formed by first joining the two opposing halves and then trimming the selected corner. Alternatively, the mold stamp used to form the clamshell pattern may be tooled to the design that includes the truncated corner and then the opposing halves may then be stamped using that tooled mold stamp and joined together in a manner discussed above. In one embodiment, forming the at least one truncated corner 205*a*, 305*a*, includes bending a corner 205, 305 of the clamshell panel 202, 302. An angle of the truncated corner 205*a*, 305*a* as taken from an adjacent edge 210, 310 of the clamshell panel 202, 302 ranges from about 30 degrees to about degrees, and in one particular embodiment is about 60 degrees. In one embodiment, a distance 215, 315 from an edge of the truncated corner 205*a*, 305*a* to an edge of the chamber path 206, 306 may be about 0.30 inches.

In those embodiments, where the truncation is achieved by bending the corner 205, 305, the step of bending includes bending the corner along a line separated from the chamber path 206, 306 by a distance that ranges from about 0.0 inches to about 0.30 inches. Further, an angle of the bending taken from a bottom plane 312 of the first opposing halve ranges from about degrees to about 15 degrees. In one aspect of this embodiment, the distance of the bend line from the chamber path is about 0.30 inches and the angle from the line taken from an adjacent edge is about 60 degrees.

Those skilled in the art to which this application relates will appreciate that other and further additions, deletions, substitutions and modifications may be made to the described embodiments.

What is claimed is:

1. A gas furnace, comprising:

a housing;

a heating zone located in said housing and comprising a burner assembly and a clamshell heating chamber, the clamshell heating chamber chambers comprising:

a male half;

a female half configured to receive the male half, the male half and the female half forming the clamshell heating chamber when joined together;

a chamber path passing through the clamshell heating chamber, the chamber path comprising:

an inlet coupled to the chamber path for receiving combustion air from the burner assembly into the chamber path;

an outlet coupled to the chamber path for exhausting the combustion air from the chamber path;

one fold positioned between the inlet and the outlet; and wherein the chamber path divides into a plurality of paths between the inlet and the one fold;

a truncated corner located adjacent a curve in a backend of the chamber path, the truncated corner located diagonally opposite from a combustion location of the heating zone, wherein said truncated corner is defined by a bent portion of a corner of said clamshell heating chamber, said bent portion being bent toward the male half; and a blower located adjacent said heating zone and positioned to force air through said heating zone.

2. The gas furnace of claim 1, wherein an angle of said truncated corner as taken from an adjacent edge of said clamshell heating chamber ranges from 30 degrees to 75 degrees.

3. The gas furnace of claim 2, wherein said angle is between 57 degrees and 63 degrees.

4. The gas furnace of claim 2, wherein a distance from an edge of said truncated corner to an edge of said chamber path ranges from 0.0 inches to 0.50 inches.

5. The gas furnace of claim 4, wherein said distance is between 0.27 inches and 0.33 inches.

6. The gas furnace of claim 1, wherein said bent portion is bent along a line that is located a distance from said chamber path that ranges from 0.0 inches to 0.30 inches.

7. The gas furnace of claim 6, wherein an angle of said bent portion as taken from a bottom plane of said male half ranges from 10 degrees to 15 degrees.

8. The gas furnace of claim 7, wherein said distance is between 0.27 inches and 0.33 inches and said angle of said bent portion is between 57 degrees and 63 degrees.

* * * * *